United States Patent [19]

Worthen

[11] 4,362,134

[45] Dec. 7, 1982

[54] SHIELDED VALVE

[75] Inventor: Roger P. Worthen, Farmington Hills, Mich.

[73] Assignee: Eaton Corporation, Cleveland, Ohio

[21] Appl. No.: 189,472

[22] Filed: Sep. 22, 1980

Related U.S. Application Data

[63] Continuation of Ser. No. 908,330, May 22, 1978, abandoned.

[51] Int. Cl.[3] ..... F01L 3/20

[52] U.S. Cl. ..... 123/188 AA; 123/188 VA

[58] Field of Search ..... 123/188 A, 188 AA, 188 VA

[56] References Cited

U.S. PATENT DOCUMENTS

| | | | |
|---|---|---|---|
| 1,727,621 | 9/1929 | Taub | 123/188 VA |
| 1,868,138 | 7/1932 | Fisk | 29/156.7 R |
| 2,032,162 | 2/1936 | Zahodiakin | 123/188 VA |
| 2,165,871 | 7/1939 | Rector | 123/188 VA |
| 2,218,321 | 10/1940 | Wurtele | 123/275 |
| 2,868,187 | 1/1959 | Meurer | 123/188 VA |
| 2,869,532 | 1/1959 | Sourdillon | 123/188 VA |
| 3,728,994 | 4/1973 | Bachle | 123/188 GC |
| 3,903,855 | 9/1975 | Klakulak et al. | 123/90.14 |
| 3,995,609 | 12/1976 | Klomp | 123/188 S |
| 4,094,277 | 6/1978 | Goto et al. | 123/52 MF |
| 4,300,492 | 11/1981 | Bart | 123/188 AA |

FOREIGN PATENT DOCUMENTS

| | | | |
|---|---|---|---|
| 814682 | 9/1951 | Fed. Rep. of Germany | 123/188 VA |
| 1066669 | 6/1954 | France | 123/188 VA |
| 300728 | 11/1928 | United Kingdom | 123/188 VA |

OTHER PUBLICATIONS

Liebert, et al., "Industry Tests of NASA Ceramic Thermal Barrier Coating", Jun. 1979, pp. 5, 9, 22 of NASA Technical Paper 1425.

*Primary Examiner*—Craig R. Feinberg
*Assistant Examiner*—W. R. Wolfe
*Attorney, Agent, or Firm*—C. H. Grace; F. M. Sajovec

[57] ABSTRACT

A shielded poppet valve (10) for a diesel engine is disclosed. In one embodiment the valve includes a fillet heat shield (12) which is fixed at one end (22) to the valve stem (20) to define a thermal insulating cavity (30) open at the other end (24). Another embodiment includes a valve (10') and a fillet heat shield (12'), both identical to the valve (10) and shield (12), and a face heat shield (34).

6 Claims, 2 Drawing Figures

SHIELDED VALVE

CROSS-REFERENCE TO RELATED APPLICATION

This application is related to application Ser. No. 104,928 filed Dec. 28, 1979, now U.S. Pat. No. 4,300,492 assigned to Eaton Corporation and a continuation of application Ser. No. 908,330 filed May 22, 1978 and now abandoned.

BACKGROUND OF THE INVENTION

1. Field of the Invention

This invention relates to an insulated valve for an internal combustion engine and more specifically to a fillet heat shield for a poppet valve in such an engine.

2. Description of the Prior Art

Shields or thermal barriers for protecting valves in piston engine combustion chambers are well-known. For many years such shields or barriers have been proposed for poppet type exhaust valves to reduce heat corrosion and weakening of valves and to reduce heat flow from combustion gases to the valves. For example, U.S. Pat. No. 1,868,138 issued to E. J. Fisk in 1932 discloses several thermal barrier embodiments which cover the face portion of an exhaust valve to insulate or shield the valve from combusting gases in the combustion chamber. U.S. Pat. No. 1,727,621 issued to A. Taub in 1929 discloses several thermal barrier embodiments which cover the fillet and part of the stem of an exhaust valve to insulate or shield the valve from combusted gases when the valve is open. Neither of these patents or analogous patents teach or suggest any advantages in shielding both the valve face and fillet. Further both of these patents are concerned with inhibiting heat flow into a valve.

Analytical studies and testing in connection with the instant invention on one particular diesel engine indicates that (1) the fillet of an exhaust valve without a shielded face operates at substantially the same average temperature as the exhaust gases flowing over the fillet, (2) a fillet heat shield on an intake valve without a shielded face can reduce about 65 percent of the heat flowing from the valve fillet and stem to the incoming air or air fuel mixture, and (3) a fillet heat shield or an intake valve with a shielded face can reduce about 90 percent of the heat flowing from the valve fillet and stem to an incoming air or air fuel mixture. The first of these three items indicates that for this particular engine there is little or no advantage in shielding only the fillet portion of an exhaust valve. Hence, a fillet heat shield on an exhaust valve not having a face shield is of little value. The second and third items indicate that a fillet heat shield on an intake valve or a fillet and face shield on an intake valve can substantially reduce heat flow from the valve fillet to the incoming air or air fuel mixture, whereby a cooler intake charge is ingested by the combustion chamber with a resultant increase in the amount of ingested charge, with a resultant reduction in $NO_x$ which decreases logarithmically with lower temperatures, and with a reduction in octane requirements which decrease with decreasing temperatures.

Further, since the surface of the fillet shield is substantially cooler than the fillet surface of an unshielded valve, coking of the fillet by a fuel-air charge is inhibited.

In addition to the above, face heat shields can significantly reduce fuel consumption and improve exhaust emission quality during engine warm-up, since the face shields warm up faster than the faces of unshielded valves.

Further, valves with both face and fillet heat shields reduce heat flow to the engine structure and cooling system via valve contact with the engine structure, whereby additional power may be extracted from the exhaust gases when the engine is turbo-charged and/or turbocompounded.

SUMMARY OF THE INVENTION

An object of this invention is to provide an internal combustion engine intake valve having a reduced heat flow to an incoming air or fuel air charge.

Another object of this invention is to provide an internal combustion engine poppet valve shielded against heat flow to or from the valve.

Another object of this invention is to provide a poppet valve having an improved fillet heat shield.

According to a feature of the invention an intake valve for an internal combustion engine includes a fillet heat shield fixed against movement relative to the valve.

According to another feature of the invention a poppet valve for an internal combustion engine includes a thermal heat shield covering the face of the valve head, and a thermal heat shield spaced from and covering the valve fillet.

According to another feature of the invention a poppet valve includes a fillet heat shield fixed only to the valve stem and defining a thermal insulating cavity which is open at the other end.

BRIEF DESCRIPTION OF THE DRAWING

The invention is shown in the accompanying drawing in which.

Figure 1:
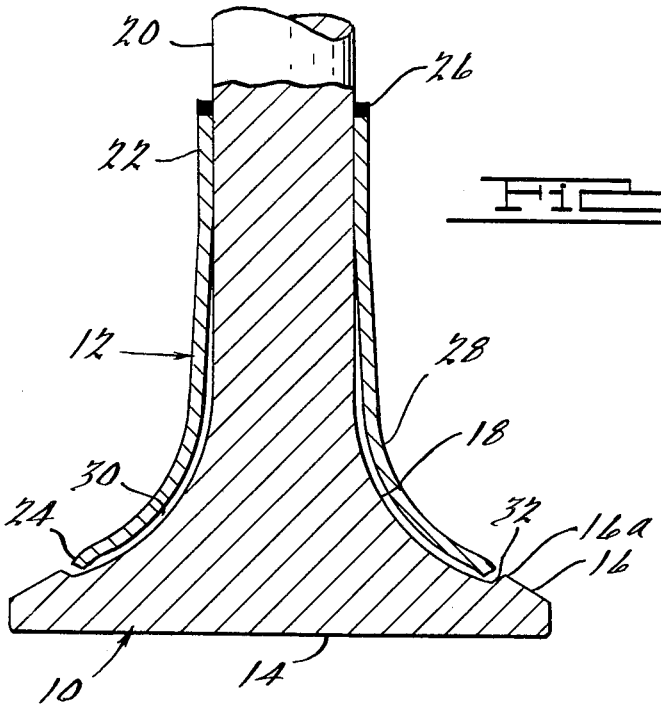
FIG. 1 shows a poppet valve with an improved fillet heat shield covering the valve fillet.

Certain terminology referring to the proposed environment and direction of components will be used in the following description. This terminology is for convenience in describing the disclosed embodiments and should not be considered limiting unless explicitly used in the appended claims. Further, elements or components in the embodiment of FIG. 2 which are identical to elements or components in FIG. 1 will be identified by the same numbers suffixed with a prime.

DETAILED DESCRIPTION OF THE DRAWING

Referring now to FIG. 1, therein is shown a poppet valve 10 having a fillet heat shield 12 fixed thereto. Valve 10 is intended, but not limited, for use as an intake valve of an expansible chamber engine of the internal combustion type which cyclically compresses and combusts air fuel mixtures, e.g., a piston engine. The invention fillet heat shield is intended for use in a diesel engine; however, it is not so limited to such an engine.

Valve 10 includes a surface having a face portion 14 which is normally exposed to combusting gases in a combustion chamber (not shown), a frustoconical valve seat portion 16 which cooperates with a mating seat (not shown) to control the flow of an incoming air or fuel-air charge when the valve functions as an intake valve or the flow of exhaust gases when the valve functions as an exhaust valve, a fillet portion 18, and a partially shown stem portion 20. Face 14, seat 16, and a part of fillet 18 define the valve head. As is well-known the fillet portion and a part of the stem portion are exposed to incoming air or exhaust gases depending on whether the valve is used as an intake valve or an exhaust valve. When the valve is used as an intake valve, a substantial amount of heat flows from the relatively hot surface of the valve fillet and stem to the incoming air or air-fuel charge, thereby heating the air. In fact, for the particular diesel engine previously mentioned, as much as two-thirds of the heat flowing into the intake valve flows to the incoming air or fuel-air charge via the intake valve fillet and stem. Such heating is known to have several disadvantages in engine operation. For example, with respect to emissions, the amount of $NO_x$ in exhaust gases increases logarithmically with temperature increases. With respect to power for a given size engine, the mass flow of air through the engine decreases in direct proportion to increases in incoming air temperature with a resultant decrease in engine power.

Fillet heat shield 12, which may be formed in many different ways and from many different materials, is herein preferably formed of a relatively thin sheet metal which covers the fillet portion 18 and part of the stem portion 20. Shields having a thickness of 0.020 inches (0.508 mm) have been tested. Shield 12 includes ends 22 and 24. End 22 is a relatively short tubular portion snugly received by stem portion 20 and fixed thereto by an electron beam weld 26. End 24 and the somewhat bell-shaped portion 28 between the ends are spaced from the valve surface. The inner surface of the bell-shaped portion 28 and the covered part of the valve surface define a thermal insulating cavity 30 which is closed at its end distal from the valve head and which is opened at a position radially inward of the minor diameter 16*a* of the frustoconical valve seat 16. To streamline air or exhaust gas flow over the valve seat and end 24 of the shield, the valve surface radially inward of minor diameter 16*a* may be provided with a recess 32 which smoothly transistions into the fillet so that the outer surface of the fillet shield may be smoothly blended with the valve surface radially outward of the recess. Cavity 30 may be filled or partly filled with an insulating material.

Since shield 12 is fixed to valve 10 at a position remote from the high temperature part of the valve, namely the valve head, conductive heat flow from the valve to the shield and vice versa is greatly reduced. Empirical temperature measurements show that shield 12 on an intake valve can reduce heat flow from the valve fillet and stem to the incoming air or fuel air charge by about 65 percent.

Figure 2:
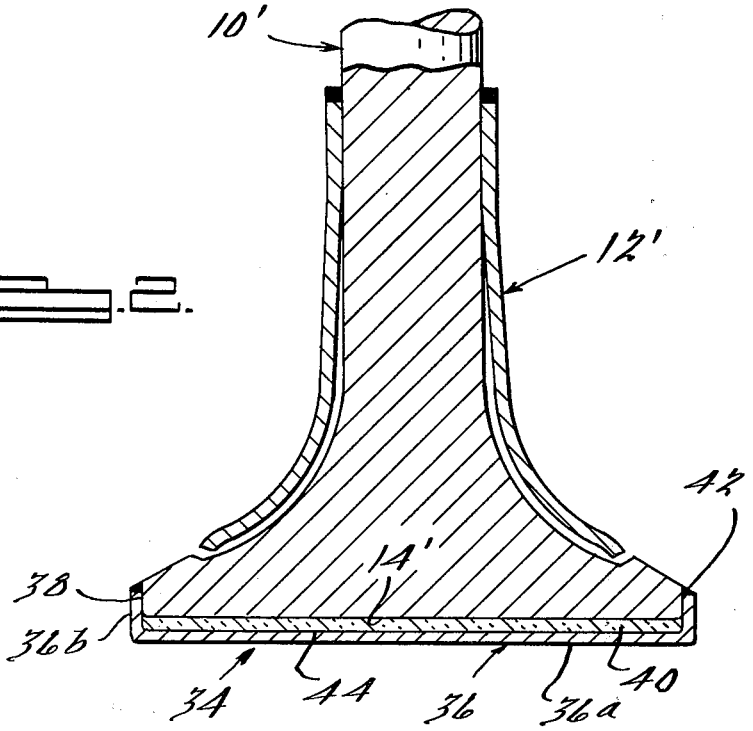
FIG. 2 shows a poppet valve with a heat shield covering the face of the valve head and the improved fillet heat shield covering the valve fillet.

Looking now at FIG. 2, therein is shown a valve 10' having a fillet heat shield 12' and a face heat shield 34. Shield 34 is substantially identical to the shield shown in FIG. 1 of U.S. patent application Ser. No. 104,928 mentioned herein in the Cross-Reference to Related Applications and incorporated herein by reference.

Valve 10' and fillet shield 12' are identical to the valve and fillet shield in FIG. 1 and therefore will not be described in further detail. Face shield 34 may be any of several known thermal barriers for valve faces. Shield 34 includes a cupshaped member 36 formed of a relatively thin sheet metal having a disk-shaped portion 36*a* spaced from face portion 14', and a cylindrical skirt portion 36*b* integrally formed with the disk portion and extending completely around the periphery of the disk portion. Skirt portion 36*b* embraces or circumscribes face portion 14', telescopes over a cylindrical surface portion 38 of valve 10', and defines in combination with disk portion 36*a* and face portion 14' a chamber 40 which, when evacuated and hermetically sealed, provides a thermal barrier for conductively insulating the valve head from combusting gases. The end of portion 36*b* distal from the disk portion 36*a* is welded to cylindrical wall portion 38 by a continuous weld 42 which hermetically seals chamber 40. The welding may be done in a vacuum by an electron beam welder, whereby chamber 40 is evacuated during the welding process.

An important purpose of skirt 36*b* is to minimize stresses caused by the difference in thermal expansion between disk 36*a* and the valve head. When valve 10' is installed in an engine, disk portion 36*a*, which is in direct contact with combusting gases, warms up relatively fast and may reach temperatures ranging from 500 to 1,000 Fahrenheit degrees greater than the valve head, whereby the disk portion will tend to thermally expand radially outward greater amounts than the valve head. Restricting the relative expansion between the disk portion and the valve head causes stressing of the shield and the weld. These stresses can cause structured failure of the shield and/or the weld if not controlled. To this end, skirt portion 36*b*, which is conductively connected to the relatively hot disk portion 36*a* and to the relatively cool valve head, has a temperature gradient over its length between the disk portion and the valve head or weld. This gradient and radially outward forces from thermal expansion of the disk causes the skirt portion to expand varying amounts over its length in bellmouth fashion. The stresses due to the expansion are reduced by making the skirt length as long as practicable with respect to the diameter of the disk. Skirt lengths 1/10 to 1/12 of the disk diameter have been satisfactorily tested in a diesel engine without failure.

The evacuated chamber 40 is preferably filled with an insulating material 44 to reduce the amount of heat radiated across chamber 40 and to provide reinforcement of the disk portion, which due to its thinness is subject to oil-canning from the cyclic pressures in the combustion chamber.

Cup-shaped member 36 is preferably fabricated from thin sheet metal alloy which is resistant to heat corrosion, such as Hastalloy-S. The thickness of the sheet metal is preferably as thin as possible, commensurate with structural integrity, to minimize added weight to the valve, to reduce heat transfer along the skirt portion to the valve head, and to facilitate fast warm-ups of the shield or sheet metal. This last feature can significantly reduce fuel consumption and improve exhaust emission quality during engine warm-ups.

Empirical temperature measurements show that an intake valve with a fillet heat shield and a face heat shield can reduce heat flow from the valve fillet and stem to the incoming air or fuel-air charge by about 90 percent; that is contrasted with the 65 percent improvement over an intake valve having only a fillet heat shield.

Two embodiments of the invention have been disclosed for illustrative purposes. Many variations and modifications of the disclosed embodiments are believed to be within the spirit of the invention. The following claims are intended to cover the inventive portions of the disclosed embodiments and variations and modifications believed to be within the spirit of the invention.

What is claimed is:

1. In an intake valve of the type including a surface defining a face portion normally exposed to combusting gases in a combustion chamber of an expansible chamber engine, a frustoconical valve seat portion having a minor diameter, a stem portion partly exposed to incoming air for the chamber, and a fillet portion disposed between the seat and stem portions and also exposed to the incoming air, a fillet heat shield fixed against movement relative to the valve, said shield having a portion covering the fillet portion and a part of the stem portion for reducing the amount of heat flow from the fillet and stem portions to the incoming air, said fillet heat shield being fixed to the stem portion at its end distal from the valve seat portion, the surface of said shield adjacent the stem portion and fillet portion and the covered surface of the valve defining a thermal insulating cavity closed at its fixed end and open at its other end positioned radially inward of the inner diameter of the frustoconical valve seat.

2. In an intake valve of the type including a surface defining a face portion normally exposed to combusting gases in a combustion chamber of an expansible chamber engine, a frustoconical valve seat portion having a minor diameter, a stem portion partly exposed to incoming air for the chamber, and a fillet portion disposed between the seat and stem portions and also exposed to the incoming air, a fillet heat shield comprising:

a metal member fixed at its end distal from the seat portion to the stem portion and thereafter spaced from the remainder of the valve surface to define a thermal insulating cavity which opens radially inward of the minor diameter of the frustoconical valve seat.

3. In an intake valve of the type including a surface defining a face portion normally exposed to combusting gases in a combustion chamber of an expanding chamber engine, a frustoconical valve seat portion having a minor diameter, a stem portion partly exposed to incoming air for the chamber, and a fillet portion disposed between the seat and stem portions and also exposed to the incoming air, the improvement comprising:

a fillet heat shield fixed against movement relative to the valve, said shield having a portion covering the fillet portion and a part of the stem portion for reducing the amount of heat flow from the fillet and stem portions to the incoming air, said heat shield extending at one end from a position radially inward of the minor diameter of the frustoconical seat portion to a position wherein its other end is fixed to the valve stem, said one end and the portion of said shield between said ends spaced from the valve surface to define a thermal insulating cavity open at said one end.

4. The valve of claim 3, wherein the valve surface radially inward of the minor diameter of the frustoconical seat portion is recessed and then smoothly transistioned into said fillet portion and wherein the open end of said shield is disposed within said recess so that the one end of said shield smoothly blends with the valve surface radially outward of the recess.

5. In a poppet valve of the type including a surface defining a face portion normally exposed to combustion gases in a combustion engine chamber, a frustoconical valve seat portion having a minor diameter, a stem portion, and a fillet portion disposed between the seat and stem portions, the improvement comprising:

a fillet heat shield extending at one end from a position radially inward of the minor diameter of the frustoconical seat portion to a position wherein its other end is fixed to the valve stem, said one end and said shield between said ends spaced from the valve surface to define a thermal insulating cavity open at said one end.

6. The valve of claim 5, wherein the valve surface radially inward of the minor diameter of the frustoconical seat portion is recessed and then smoothly transistioned into said fillet portion and wherein the open end of said shield is disposed within said recess so that the outer surface of said shield smoothly blends with the valve surface radially outward of the recess.

* * * * *